US008075274B2

(12) United States Patent
Carvalho

(10) Patent No.: US 8,075,274 B2
(45) Date of Patent: Dec. 13, 2011

(54) REINFORCED COMPOSITE FAN BLADE

(75) Inventor: Paul A. Carvalho, Westfield, MA (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 276 days.

(21) Appl. No.: 12/465,109

(22) Filed: May 13, 2009

(65) Prior Publication Data

US 2010/0290913 A1 Nov. 18, 2010

(51) Int. Cl.
*F01D 5/18* (2006.01)

(52) U.S. Cl. ..... 416/213 R; 416/224; 416/226; 416/229 R; 416/241 R

(58) Field of Classification Search ..... 416/213 R, 416/215, 217, 224, 226, 229 R, 230, 241 R
See application file for complete search history.

(56) References Cited

U.S. PATENT DOCUMENTS

| | | | | |
|---|---|---|---|---|
| 3,694,104 | A * | 9/1972 | Erwin | 416/217 |
| 4,010,530 | A * | 3/1977 | Delgrosso et al. | 29/889.71 |
| 4,051,289 | A * | 9/1977 | Adamson | 428/113 |
| 4,971,641 | A * | 11/1990 | Nelson et al. | 156/64 |
| 5,051,575 | A | 9/1991 | Hino | |
| 5,222,297 | A * | 6/1993 | Graff et al. | 29/889.71 |
| 5,340,280 | A | 8/1994 | Schilling | |
| 5,346,367 | A * | 9/1994 | Doolin et al. | 416/230 |
| 5,392,514 | A | 2/1995 | Cook et al. | |
| 5,439,353 | A * | 8/1995 | Cook et al. | 416/230 |
| 5,498,137 | A | 3/1996 | El-Aini et al. | |
| 5,634,771 | A | 6/1997 | Howard et al. | |
| 5,725,355 | A | 3/1998 | Crall et al. | |
| 5,785,498 | A | 7/1998 | Quinn et al. | |
| 5,881,972 | A * | 3/1999 | Smith et al. | 244/121 |
| 5,908,285 | A * | 6/1999 | Graff | 416/224 |
| 6,676,080 | B2 | 1/2004 | Violette | |
| 6,875,297 | B1 | 4/2005 | Meuwly et al. | |
| 7,252,478 | B2 | 8/2007 | Aynsley | |
| 7,284,957 | B2 | 10/2007 | Hornick et al. | |
| 7,547,194 | B2 | 6/2009 | Schilling | |
| 2008/0072569 | A1 | 3/2008 | Moniz et al. | |
| 2008/0253922 | A1 * | 10/2008 | Trimmer et al. | 420/419 |
| 2011/0182741 | A1 * | 7/2011 | Alexander | 416/229 R |
| 2011/0194941 | A1 * | 8/2011 | Parkin et al. | 416/224 |

FOREIGN PATENT DOCUMENTS

DE 8709452 U1 11/1988

OTHER PUBLICATIONS

Extended European Search Report for International Application No. EP 10 25 0916 dated Jul. 13, 2011.

* cited by examiner

*Primary Examiner* — Michael Lebentritt
(74) *Attorney, Agent, or Firm* — Carlson, Gaskey & Olds PC

(57) ABSTRACT

A fan blade for a turbine engine includes an exterior surface defining an airfoil that is provided by leading and trailing edges, opposing generally chord-wise surfaces interconnecting the leading and trailing edges, and a tip. The airfoil extends from a root. A fan rotor includes a slot that receives the root. A spar is constructed from a first material and includes opposing sides. The spar provides at least a portion of the exterior surface. A sheath is constructed from a second material different than the first material. The sheath is arranged on both of the opposing sides to provide at least a portion of the exterior surface at the opposing surfaces.

16 Claims, 2 Drawing Sheets

REINFORCED COMPOSITE FAN BLADE

BACKGROUND

This disclosure relates to a reinforced composite fan blade for a gas turbine engine.

Gas turbine engine fan blades are designed to absorb impacts from foreign objects entering the engine. The use of composite materials for fan blades has become more prevalent. Composite fan blades provide low weight, low cost and a lower containment weight. Typically, lower containment weight enables the fan blade to be more easily contained by surrounding engine structures upon fracture.

It is more difficult to absorb impact energy with thinner composite fan blade designs. To increase the impact strength of the fan blade, a metallic outer sheath has been used. That is, a thin piece or sheet of metallic material has been secured to a composite fan blade, in particular, at a trailing edge of the blade near its tip. It is desirable to provide a more robust composite fan blade with greater impact absorption capability.

SUMMARY

A fan blade for a turbine engine is disclosed. The fan blade includes an exterior surface defining an airfoil that is provided by leading and trailing edges, opposing generally chord-wise surfaces interconnecting the leading and trailing edges, and a tip. The airfoil extends from a root. A fan rotor includes a slot that receives the root.

A spar is constructed from a first material and includes opposing sides. According to one example of the disclosed fan blade, the spar provides at least a portion of the exterior surface. A sheath is constructed from a second material different than the first material. The sheath is arranged on both of the opposing sides to provide at least a portion of the exterior surface at the opposing surfaces.

In another example of the disclosed fan blade, the spar is metallic and has an aperture that extends through to the opposing sides. The sheath is a composite that is arranged on both of the opposing sides and extends through the aperture from one of the opposing surfaces to the other of the opposing surfaces to provide at least a portion of the exterior surface at the opposing surfaces.

These and other features of the disclosure can be best understood from the following specification and drawings, the following of which is a brief description.

DETAILED DESCRIPTION

Figure 1:
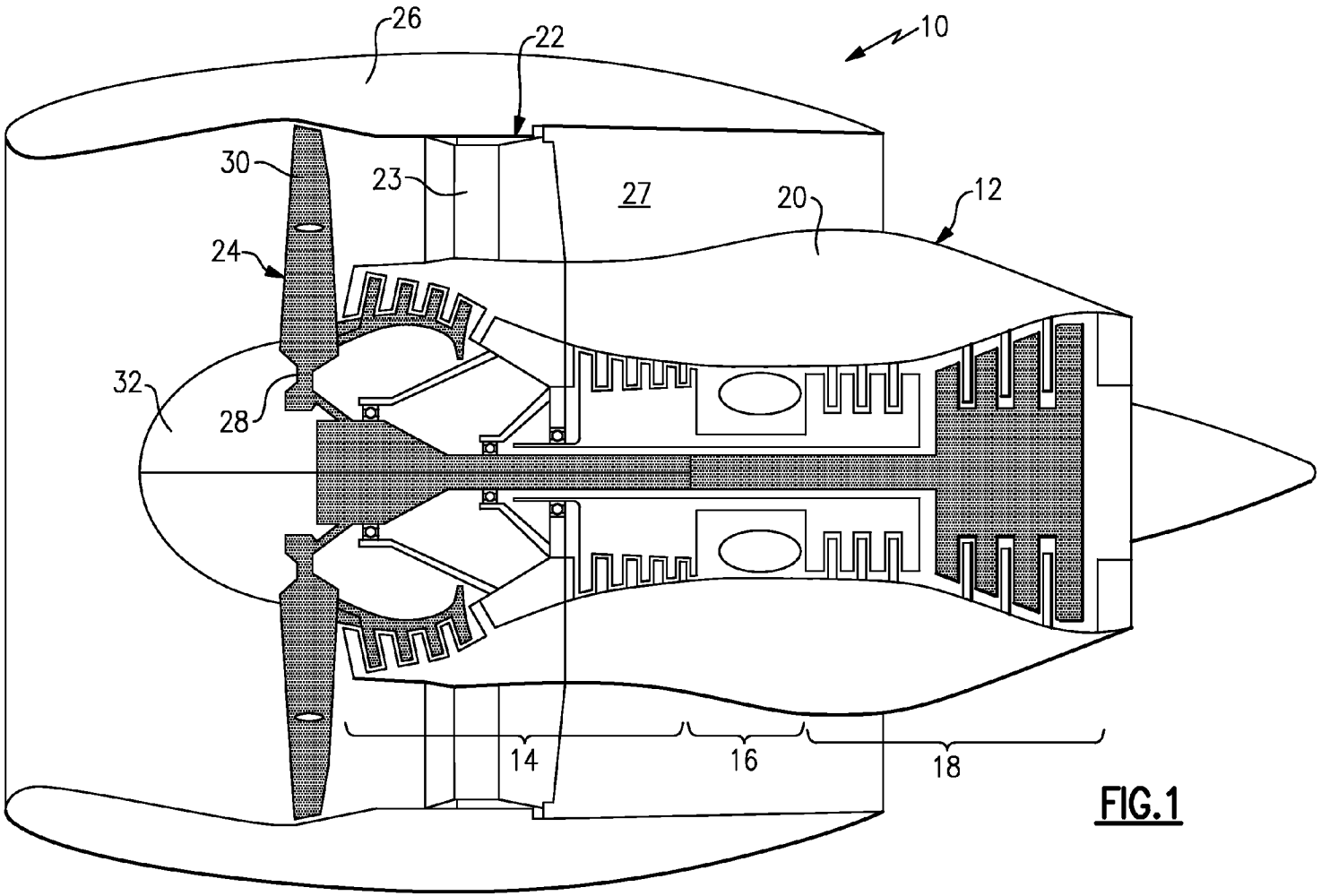
FIG. 1 is a schematic view of a gas turbine engine.

A gas turbine engine 10 is schematically illustrated in FIG. 1. The engine 10 includes a core 12 having a compressor section 14, a combustor section 16 and a turbine section 18. The sections 14, 16, 18 are disposed within a core nacelle 20 that is arranged within a fan nacelle 26. A bypass flow path 27 is provided between the core and fan nacelles 20, 26.

The fan nacelle 26 is supported by a fan case 22. The core 12 is supported by the fan case 22 with flow exit guide vanes 23. A fan 24 is disposed within the fan case 22 upstream from the bypass flow path 27. The fan 24 includes a fan rotor 28 supporting multiple circumferentially arranged fan blades 30. A nose cone 32 is secured to the fan rotor 28.

Figure 2A:
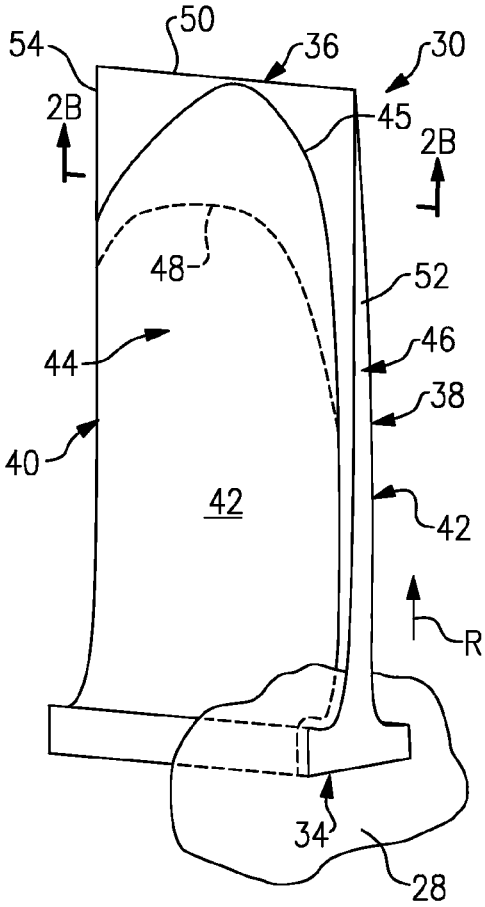
FIG. 2A is a perspective view of an example fan blade according to this disclosure.
Figure 2B:
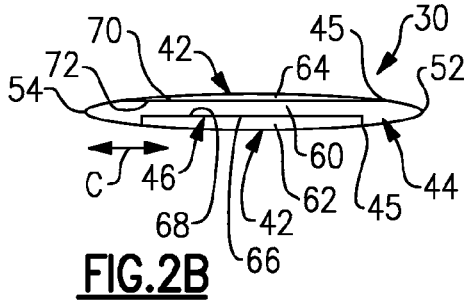
FIG. 2B is a cross-sectional view of the fan blade shown in FIG. 2A taken along line 2B-2B.

A reinforced composite fan blade 30 is illustrated in FIGS. 2A-2B. The fan blade 30 includes an airfoil exterior surface provided by a tip 36, leading and trailing edges 38, 40 and opposing surfaces 42. The airfoil extends from a root 34 that is received in a corresponding slot in the fan rotor 28. The opposing surfaces 42 are arranged in a generally chord-wise direction C and interconnect the leading and trailing edges 38, 40. The opposing surfaces 42 extend in a radial direction R from the root 34 to the tip 36 to provide pressure and suction sides of the fan blade 30.

A sheath 44 of composite material surrounds at least portions of a structural spar 46 that is used to reinforce the composite material. The spar 46 is constructed from a material having a greater fracture toughness than that of the sheath material, which increases the impact strength of the fan blade. In addition, the material can be chosen to provide greater erosion resistance on the leading edge of the blade. In one example, the composite material provides a greater percentage of the exterior surface and provides a greater volume of the fan blade than the spar material. In one example, the spar 46, sandwiched between the sheath 44, is constructed from a metallic material, such as a ductile titanium alloy. The composite is constructed from a fiber reinforced resin-based material, for example. In one example, the sheath 44 is molded over the spar 46 using a resin transfer molding (RTM) process.

In one example, the spar 46 extends from the root 34 to the tip 36. The spar 46 provides at least a portion of the root 34 and extends to the tip 36. Specifically, the spar 46 provides a portion of the root structure in one example, which is typically of a dove-tail type shape. The spar 36 provides at least a portion of the exterior surface at the tip 36 from the leading edge 38 to the trailing edge 40. In the examples, the spar 46 provides at least a portion of the exterior surface at the leading and trailing edges 38, 40. The spar 46 extends from the leading edge 38 to the trailing edge 40 at the tip 36 and radially inwardly along a portion of the trailing edge 40. Said another way, the spar includes tip, leading edge, and trailing edge surfaces 50, 52, 54 that correspondingly provide the exterior surface of the fan blade 30 at the tip 36, leading edge 38 and trailing edge 40 such that the spar 46 is exposed in those locations. A length 60 of the spar material bridges the leading and trailing edges 38, 40 within the sheath 44.

The sheath 44 and spar 46 adjoin one another at the exterior surface at a boundary 45. The sheath 44 overlaps the spar 46 from the boundary 45 to an inner edge 48 of the spar 46, which is disposed between the opposing surfaces 42. The boundary 45 is provided at both opposing surfaces 42 (see, e.g. FIG. 2B). As a result, an inner edge surface 48 of the spar is enclosed within or contained by the sheath 44 radially inwardly from the tip 36 and interiorly in the chord-wise direction C from the leading and trailing edges 38, 40. In one example, the inner edge surface 48 is generally arcuate in shape, extending a greater radial distance inwardly from the tip 36 near the leading edge 38 than at the trailing edge 40.

Referring to FIG. 2B, the sheath 44 overlaps the opposing sides 66, 70 of the spar 46 to provide the exterior surface at the opposing surfaces 42 such that the spar 46 is arranged in between the opposing surfaces 42. In one example, the sheath 44 includes interlocking surfaces 68, 72 that are of a complementary shape to the opposing sides 66, 70 to securely retain the sheath 44 to the spar 46. The sheath 44 and spar 46 are in direct engagement with one another in the example.

Figure 3A:
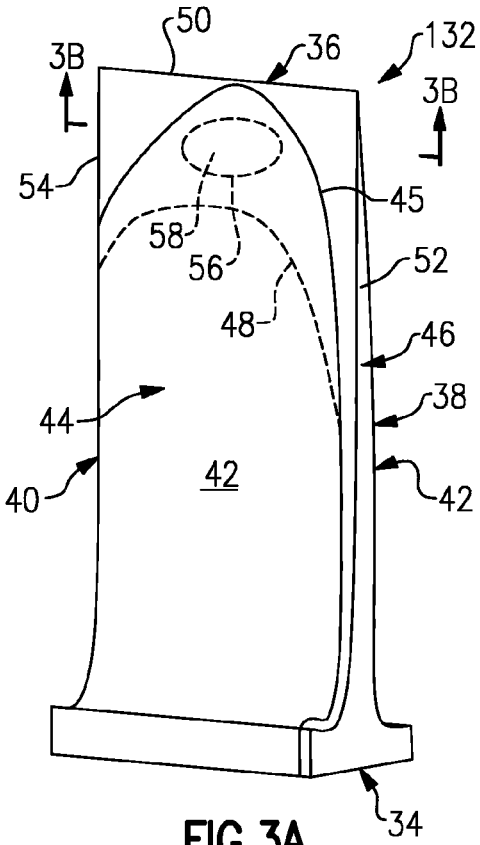
FIG. 3A is a perspective view of another example fan blade according to this disclosure.
Figure 3B:
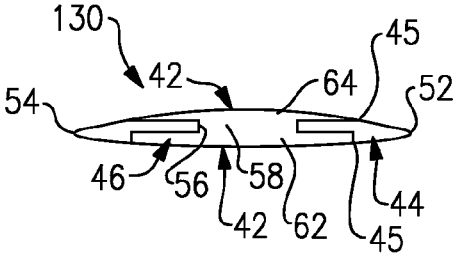
FIG. 3B is a cross-sectional view of the fan blade shown in FIG. 3A taken along line 3B-3B.

Referring to FIGS. 3A and 3B, another fan blade 130 illustrates another feature used to secure the sheath 44 to the spar 46. In the example, the spar 46 includes an aperture 56 extending between the opposing sides 66, 70, which permits the sheath 44 to extend between the opposing surfaces 42 to provide a connection 58, anchoring first and second sides 62, 64 of the sheath 44 to one another.

Although example embodiments have been disclosed, a worker of ordinary skill in this art would recognize that certain modifications would come within the scope of the claims. For that reason, the following claims should be studied to determine their true scope and content.

What is claimed is:

1. A fan blade for a turbine engine comprising:

an exterior surface defining an airfoil provided by leading and trailing edges, opposing generally chord-wise surfaces interconnecting the leading and trailing edges and a tip, the airfoil extending from a root;

a spar constructed from a first material and including opposing sides, the spar providing at least a portion of the exterior surface;

and a sheath constructed from a second material different than the first material, the sheath arranged on both of the opposing sides to provide at least a portion of the exterior surface at the opposing surfaces; wherein the sheath provides a greater volume of the fan blade and percent of the exterior surface than that of the spar.

2. The fan blade according to claim 1, wherein the spar provides at least a portion of the root and extends to the tip.

3. The fan blade according to claim 1, wherein the spar provides at least a portion of the exterior surface at the tip from the leading edge to the trailing edge.

4. The fan blade according to claim 1, wherein the spar provides at least a portion of the exterior surface at the leading and trailing edges.

5. The fan blade according to claim 1, wherein the spar provides at least a portion of the exterior surface at the leading edge.

6. The fan blade according to claim 1, wherein the spar includes an aperture, the sheath extends through the aperture from one of the opposing surfaces to the other of the opposing surfaces.

7. The fan blade according to claim 1, wherein the first material has a greater fracture toughness than that of the second material.

8. The fan blade according to claim 7, wherein the first material is metallic and the second material is a composite.

9. The fan blade according to claim 8, wherein the first material includes a titanium alloy, and the second material includes a fiber reinforced resin-based material.

10. A fan for a turbine engine comprising:

a fan rotor including a slot;

a fan blade having an airfoil extending from a root that is received in the slot, the airfoil including an exterior surface defining the airfoil which is provided by leading and trailing edges, opposing generally chord-wise surfaces interconnecting the leading and trailing edges, and a tip; the fan blade includes a spar and a sheath constructed from different materials, the spar including opposing sides and providing at least a portion of the root and at least a portion of the airfoil exterior surface, the sheath arranged on both of the opposing sides to provide at least a portion of the exterior surface at the opposing surfaces; wherein the sheath provides a greater volume of the fan blade and percent of the exterior surface than that of the spar.

11. The fan according to claim 10, wherein the spar includes an aperture, the sheath extends through the aperture from one of the opposing surfaces to the other of the opposing surfaces.

12. The fan according to claim 10, wherein the spar provides at least a portion of exterior surface at the leading edge, the portion of the exterior surface extending from the root toward the tip.

13. The fan according to claim 11, wherein the spar provides at least a portion of the exterior surface at the tip from the exterior surface portion at the leading edge toward the trailing edge.

14. The fan according to claim 13, wherein the spar provides at least a portion of the exterior surface at the trailing edge near the tip.

15. A fan blade for a turbine engine comprising:

an exterior surface defining an airfoil provided by leading and trailing edges, opposing generally chord-wise surfaces interconnecting the leading and trailing edges and a tip, the airfoil extending from a root;

a metallic spar including opposing sides and an aperture extending through to the opposing sides; and a composite sheath arranged on both of the opposing sides and extending through the aperture from one of the opposing surfaces to the other of the opposing surfaces to provide at least a portion of the exterior surface at the opposing surfaces.

16. The fan blade according to claim 15, wherein the spar provides at least a portion of the exterior surface.

* * * * *